United States Patent [19]

Kageyama et al.

[11] Patent Number: 4,740,289

[45] Date of Patent: Apr. 26, 1988

[54] PROCESS FOR THE HYDROGENOLYSIS OF A COAL LIQUID BOTTOM

[75] Inventors: Yoichi Kageyama, Isehara; Tetsuo Masuyama, Machida, both of Japan

[73] Assignees: Mitsubishi Chemical Industries Ltd., Tokyo; Kabushiki Kaisha Kobe Seiko Sho, Kobe; Idemitsu Kosan Company Limited, Tokyo; Asia Oil Company, Tokyo; Nippon Brown Coal Liquefaction Co., Ltd., Tokyo, all of Japan

[21] Appl. No.: 39,785

[22] Filed: Apr. 20, 1987

Related U.S. Application Data

[63] Continuation of Ser. No. 839,942, Mar. 17, 1986, abandoned.

[30] Foreign Application Priority Data

Apr. 1, 1985 [JP] Japan ..... 60-68696

[51] Int. Cl.[4] ..... C10G 65/10

[52] U.S. Cl. ..... 208/59; 208/412; 208/413; 208/417; 208/418; 208/419

[58] Field of Search ..... 208/57, 59, 403, 412, 208/413, 417, 419, 58, 89

[56] References Cited

U.S. PATENT DOCUMENTS

| | | | |
|---|---|---|---|
| 2,913,397 | 11/1959 | Murray, Jr. et al. | 208/412 |
| 3,796,650 | 3/1974 | Urban | 208/419 |
| 3,816,298 | 6/1974 | Aldridge | 208/58 |
| 3,844,933 | 10/1974 | Wock et al. | 208/59 |
| 3,976,559 | 8/1976 | Bearden, Jr. et al. | 208/89 |
| 4,003,823 | 1/1977 | Baird, Jr. et al. | 208/284 |
| 4,076,613 | 2/1978 | Bearden, Jr. | 208/108 |
| 4,092,236 | 5/1978 | Heredy | 208/108 |
| 4,127,470 | 11/1978 | Baird, Jr. et al. | 208/58 |
| 4,176,048 | 11/1979 | Corns et al. | 208/59 |
| 4,338,184 | 7/1982 | Maa et al. | 208/419 |
| 4,491,511 | 1/1985 | Skinner et al. | 208/412 |
| 4,591,430 | 5/1986 | Hudson | 302/328 |
| 4,595,488 | 6/1986 | Pecci et al. | 208/412 |

*Primary Examiner*—Helen M. S. Sneed
*Assistant Examiner*—Anthony McFarlane
*Attorney, Agent, or Firm*—Oblon, Fisher, Spivak, McClelland & Maier

[57] ABSTRACT

A process for the hydrogenolysis of a coal liquid bottom containing benzene-insoluble components and having a boiling point of at least 420° C., which comprises:

(a) hydrogenating the coal liquid bottom at a temperature of not higher than 350° C. in the presence of a catalyst comprising an alkali metal and/or an alkaline earth metal and a metal of Group VI A of the Periodic Table to reduce the content of the benzene-insoluble components in the fraction having a boiling point of at least 420° C., to a level of not higher than 10% by weight, and then (b) subjecting the product to hydrogenolysis at a temperature of higher than 350° C. and not higher than 450° C. in the presence of a catalyst comprising a metal of Group VI A of the Periodic Table.

14 Claims, No Drawings

PROCESS FOR THE HYDROGENOLYSIS OF A COAL LIQUID BOTTOM

This application is a continuation of application Ser. No. 06/839,942, filed on Mar. 17, 1986, now abandoned.

The present invention relates to a process for producing a light oil by the hydrogenolysis reaction of a coal liquid bottom (hereinafter referred to simply as "CLB") obtained by the liquefaction reaction of coal and having a boiling point of at least 420° C. under atmospheric pressure. More particularly, it relates to a process for the hydrogenolysis of CLB to obtain a light oil from coal quantitatively for a long period of time and in good yield.

In the hydrogenolysis of CLB obtained by the liquefaction reaction of coal, particularly in a fixed bed reaction system, it is most important and extremely difficult to control or at least reduce the reaction on the catalyst for the formation of carbonaceous substances, which causes deactivation of the catalyst or plugging of the catalyst bed, and to maintain the high catalytic activity for a long period of time.

In order to obtain a light oil in good yield from CLB containing benzene-insoluble components in a high concentration, it is common to conduct the reaction at a high temperature. However, the direct reaction at a high temperature causes a substantial reduction of the catalytic activities, and leads finally to plugging. The starting substances or the precursor for the reaction for the formation of the carbonaceous substances which causes these problems, is contained in the benzene-insoluble components in CLB. Namely, it has been confirmed that the desired catalytic activities are obtainable over a long period of time with no substantial reduction of the catalytic activity and without plugging of the catalyst bed, when the reaction is conducted by using, as the starting material, CLB having not only the ash content but also the benzene-insoluble components i.e. so-called preasphaltene components removed by a solvent deashing method (see, for instance, Japanese Unexamined Patent Publication No. 122589/1984).

However, according to this method, the benzene-insoluble components which can be a light oil source, are discharged out of the system. Therefore, the yield from the coal is inevitably low, and the costs for the starting material and for the treatment of the wastes are high, thus leading to an economical disadvantage.

The present inventors have conducted extensive research taking the above-mentioned problems in the solvent deashing method into account, and as a result, have found that it is possible to obtain a light oil in good yield over a long period of time without plugging of the catalyst bed even when CLB containing benzene-insoluble components is directly supplied to the reaction, by conducting the reaction of the first stage where the concentration of the benzene-insoluble components in the starting material CLB is high, at a low temperature and conducting the reaction of the later stage where the concentration becomes low after the conversion, at a high temperature, and by employing specific catalysts in the first and later stages, respectively. The present invention is based on this discovery.

Namely, the present invention provides a process for the hydrogenolysis of a coal liquid bottom containing benzene-insoluble components and having a boiling point of at least 420° C., which comprises:

(a) hydrogenating the coal liquid bottom at a temperature of not higher than 350° C. in the presence of a catalyst comprising an alkali metal and/or an alkaline earth metal and a metal of Group VI A of the Periodic Table to reduce the content of the benzene-insoluble components in the fraction having a boiling point of at least 420° C., to a level of not higher than 10% by weight, and then (b) subjecting the product to hydrogenolysis at a temperature of higher than 350° C. and not higher than Z5 450° C. in the presence of a catalyst comprising a metal of Group VI A of the Periodic Table.

Now, the present invention will be described in detail with reference to the preferred embodiments.

CLB in the present invention is a distillation residue having a boiling point of at least 420° C. under atmospheric pressure, which remains after distilling off the light oil from a reaction product obtained either by treating a coal such as brown coal, bituminous coal, sub-bituminous coal or lignite together with a hydrocarbon solvent, with high pressure hydrogen at a high temperature in the absence or presence of a catalyst such as an iron-type catalyst, or by the catalytic hydrogenolysis of a coal. CLB obtained by a solvent extraction liquefaction method is called a solvent-refined coal. CLB thus obtained is solid at room temperature under atmospheric pressure, but is mostly soluble in quinoline or pyridine although it contains minor amounts of the ash content contained in the starting material coal used for the liquefaction of coal or insolubles such as used catalysts. Usual CLB comprises from about 25 to 40% of benzene-insoluble components and from about 50 to 80% of n-heptane insoluble components, as separated by benzene and n-heptane. For the reaction of the present invention, benzene-insoluble components are of particular importance, and they are a mixture of aromatic organic substances having relatively high molecular weights and relatively high contents of hetero atoms such as N and O. They have a higher degree of condensation of aromatic rings i.e. a higher C/H ratio as compared with benzene-soluble components.

CLB to be used in the present invention is preferably the one obtained as a reaction product of the hydrogenolysis of coal. Usually, however, it is obtained by a combination of a conventional solvent deashing method or deashing technique as disclosed in Japanese Unexamined Patent Publication No. 122589/1984. Usually, CLB containing at least 10% by weight (hereinafter, "%" means "% by weight" unless otherwise specified) and not more than 40% of benzene-insoluble components, is supplied for the hydrogenolysis reaction.

Said reaction is divided into a first step wherein the content of benzene-insoluble components in the fraction having a boiling point of at least 420° C. in CLB become not higher than 10%, and a later step for subsequent treatment.

The reaction of the first step is conducted at a temperature of not higher than 350° C., preferably from 250° to 350° C., more preferably from 280° to 340° C. Generally, the reaction is conducted at a low temperature for a long period of time as the content of benzene-insoluble components is high.

The catalyst employed in the first step comprises at least one metal selected from metals of Group VI A of the Periodic Table such as Mo and W and at least one metal selected from alkali metals such as K and Na and/or alkaline earth metals such as Ca and Ba, as essential elements. Further, it is preferred to incorporate a Group VIII metal such as Ni or Co.

Such a catalyst is employed as supported on a carrier such as alumina or silica alumina.

Usually, the proportions of the respective metal components in the catalyst are such that the Group VI A metal is from 2 to 20%, preferably from 4 to 15%, as metal, and the alkali metal or the alkaline earth metal is from 0.1 to 10%, preferably from 0.5 to 5%, as metal. Further, the Group VIII metal is from 0 to 8%, preferably from 3 to 6%, as metal.

The catalyst may be prepared by various conventional methods such as a impregnating method, a kneading method, a co-precipitation method or a co-gelation method. However, there may be mentioned as typical examples a method wherein salts of the Group VI A metal and the alkali metal and/or alkaline earth metal, and if necessary the Group VIII metal, are impregnated into a carrier, followed by calcination, or a method in which a part thereof is preliminarily supported on a carrier, and the rest of the components are subsequently supported. In any case, the catalyst components are present in the form of their oxides on the carrier.

Specifically, the reaction is conducted by dissolving CLB in a solvent and passing the solution together with hydrogen gas through a reactor such as a fixed bed reactor.

The solvent is preferably a heavy oil obtained by the liquefaction of coal, such as the one having a boiling point of at least 180° C. However, the solvent is not restricted to such a heavy oil, and those useful for the conventional liquefaction of coal such as coal type or petroleum type heavy oils may be employed. The solvent/CLB ratio is from 0.1 to 10, preferably from 1 to 5 by weight. The representative reaction conditions are a hydrogen pressure of from 10 to 300 kg/cm$^2$G, preferably from 50 to 250 kg/cm$^2$G, and a liquid space velocity of from 0.01 to 20 hr$^{-1}$, preferably from 0.1 to 10 hr$^{-1}$. The $H_2$/liquid ratio is from 100 to 5000 liter (N.T.P.)/liter, preferably from 500 to 2000 liter (N.T.P.)/liter. After the content of the benzene-insoluble components in the fraction having a boiling point of at least 420° C. in the reaction product becomes not higher than 10% by such a reaction of the first step, the reaction of the later step is conducted. The reaction of the later step is conducted at a temperature of higher than 350° C. and not higher than 450° C., preferably from 355° to 445° C., more preferably from 370° to 420° C. in the presence of a catalyst carrying a metal of Group VI A of the Periodic Table. The catalyst may include an alkali metal and/or an alkaline earth metal. Further, it is preferred to incorporate a Group VIII metal such as Ni or Co.

There is no particular restriction as to the reaction conditions of the later step so long as the reaction temperature and the catalyst used are as mentioned above, and other reaction conditions may be similar to those of the first step. The first step and the later step may be conducted in separate reactors, or may be conducted in a single reactor divided into a plurality of reaction zones.

From the reaction product obtained by the process of the present invention, a desired light oil such as naphtha or kerosene can be obtained by such means as gas-liquid separation or distillation. According to the process of the present invention, the decomposition of benzene-insoluble components can efficiently be carried out under the reaction conditions of the first step, whereby a light oil can constantly be obtained in good yield over a long period of time even with CLB having benzene-insoluble components.

It has been reported that the efficiency of hydrogenation can be improved by removing an alkali metal or an alkaline earth metal in CLB (Japanese Unexamined Patent Publication No. 109589/1984). Nevertheless, according to the present invention, the above-mentioned efficiency can be obtained by the use of a catalyst carrying an alkali metal and/or an alkaline earth metal. It is believed that in the process disclosed in Japanese Unexamined Patent Publication No. 109589/1984, impurities deposited on the catalyst such as silicon or the catalyst used together with an alkali metal or an alkaline earth metal for the hydrogenation of coal to obtain CLB, would reduce the efficiency of the reaction.

According to the present invention, the following effects are obtainable, which are not obtainable by conventional processes.

(1) It is possible to obtain a light oil quantitatively in good yield over a long period of time from CLB containing benzene-insoluble components at a high concentration.

(2) The benzene-insoluble components which used to be regarded as a catalyst poison, can effectively be used as a light oil source. This contributes to the saving of the starting material, and brings about a considerable economical advantage.

Now, the present invention will be described in further detail with reference to Examples. However, it should be understood that the present invention is by no means restricted by these specific Examples.

EXAMPLE 1

A starting material (16.1% of benzene-insoluble components, 59.3% of n-heptane insoluble components, C: 81.1%, H: 5.4%, N: 1.5%, S: 0.3%, O: 11.7%) obtained by extracting CLB obtained by the liquefaction of Australian Morwell coal, with a solvent mixture of toluene (hereinafter referred to simply as "TL") and tetrahydrofuran (hereinafter referred to simply as "THF") (TL/THF weight ratio: 5/1) at room temperature, was mixed and dissolved in a hydrogenated creosote oil (bp: 250°-420° C./760 mmHg, C: 90.6%, H: 7.2%, N: 4.6%, S: 0.1%, O: 1.7%, fa =0.7799) in a weight ratio of 1:2. The solution was fed together with hydrogen gas into a trickle-type fixed bed reaction apparatus comprising two reactors connected in series each having an inner diameter of 13 mm$\phi$ with an external heating system and being different from each other in the temperature and the type of the catalyst, under a pressure of 100 kg/cm$^2$G at a liquid supply rate of 50 g/hr, in a $H_2$/liquid ratio of 890 liter (N.T.P.)/liter with the temperature of the reactor for the first step being 320° C. and the temperature of the reactor for the later step being 400° C. The catalysts used in the first step and in the later step were cylindrical products obtained by extrusion dies of 1.3 mm$\phi$×4 mm$\phi$. The catalyst in the first step comprised nickel (7.4% as NiO), molybdenum (9.6% as $MoO_3$) and calcium (3.1% as CaO) supported on an alumina carrier. Likewise, the catalyst used in the later step comprised nickel (4.1% as NiO) and molybdenum (15.2% as $MoO_3$) supported on an alumina carrier.

The reaction product thus obtained was separated into a gas component and a liquid component. The gas component was analyzed by gas chromatography. The liquid component was fractionated by kolben distillation, and the reaction results were obtained by the following calculation. The conversion of CLB, the yield of the liquid oil and the yield of naphtha did not change as measured upon expiration of 20 and 200 hours from the initiation of the reaction, and they were 50%, 40% and 12%, respectively.

$$CLB \text{ conversion } (\%) = \left\{ 1 - \frac{\text{Bottom of recovered reaction product (bp} \geqq 420^\circ \text{ C.) (g/hr)}}{\text{Feed } CLB \text{ (g/hr)}} \right\} \times 100$$

$$\text{Yield of liquefied oil } (\%) = \frac{\text{Recovered liquefied oil (bp} < 420 \text{ C.) (g/hr)}}{\text{Feed } CLB \text{ (g/hr)}} \times 100$$

$$\text{Yield of naphtha } (\%) = \frac{\text{Recovered naphtha (bp} < 180 \text{ C.) (g/hr)}}{\text{Feed } CLB \text{ (g/hr)}} \times 100$$

Upon expiration of 20 and 200 hours from the initiation of the reaction, a small amount of the liquid was withdrawn from the outlet of the reactor for the first step, and the benzene-insoluble components were measured and found to be 0.5% and 0.6%, respectively (from the results of Example 2, the concentrations in the fractions having a boiling point of at least 420° C. were 1.7% and 2%, respectively). The benzene-insoluble components in the starting solution (CLB+hydrogenated creosote oil) were 5.4% (16.1% in CLB). The proportion of the benzene-insoluble components was obtained by mixing 3 g of the solution with 100 ml of benzene, refluxing the mixture for 2 hours, then filtering it, and calculating the proportion from the filtration residue. The above- mentioned 0.5% and 0.6% are substantially equal within the analytical errors. Namely, no deterioration of the catalytic activity was observed in the first step, and no deterioration of the catalytic activity was observed throughout the entire reaction. Thus, the catalytic activity was constant in each of the first step and the later step during the test period.

EXAMPLE 2

The reaction was conducted under the same conditions as in Example 1 except that the starting material was passed through only the reactor for the first step. The CLB conversion and the yield of liquefied oil upon expiration of 20 hours from the initiation of the reaction were 10% and 8.8%, respectively. No formation of naphtha and gas was observed. The content of benzene-insoluble components in the reaction solution was 0.6%.

The results of Example 2 correspond to the reaction results at the outlet of the reactor for the first step in Example 1. This means that in the reactor for the later step, CLB with a conversion of 10% was converted to 50%. Namely, a reaction of 40% was conducted in the later step.

COMPARATIVE EXAMPLE 1

The reaction was conducted in the same manner as in Example 1 except that the starting material was supplied only to the reactor of the later step. The CLB conversion, the yield of liquefied oil and the yield of naphtha upon expiration of 20 hours from the initiation of the reaction, were 41%, 31% and 12%, respectively. The corresponding reaction results upon expiration of 200 hours were 38%, 29% and 8%. In both cases, the reaction results were inferior.

As is evident from the comparison between the reaction results in the reactor for the later step in Example 1 and those of Comparative Example 1, the reacted amount in each case was about 40%, but when the starting material having a high concentration of benzene-insoluble components is directly supplied to the reactor, the catalytic activity lowers. Whereas, when the concentration of benzene-insoluble components was low, no deterioration of the catalytic activity was observed.

COMPARATIVE EXAMPLE 2

The reaction was conducted in the same manner as in Example 1 except that the temperature of the reactor for the later step was changed to 460° C. without changing the temperature of the reactor for the first step. The CLB conversion, the yield of liquefied oil and the selectivity for liquefied oil upon expiration of 20 hours from the initiation of the reaction, were 95%, 60% and 63%, respectively. The gas yield was 30%. Further, upon expiration of 100 hours, the CLB conversion lowered to 90%.

The selectivity for liquefied oil is low under these conditions, and the deterioration of the catalytic activity was observed.

$$\text{Selectivity for liquefied oil } (\%) = \frac{\text{Yield of liquefied oil } (\%)}{CLB \text{ conversion } (\%)} \times 100$$

$$\text{Gas yield } (\%) = \frac{\text{Recovered } C_1\text{–}C_5 \text{ (g/hr)}}{\text{Feed } CLB \text{ (g/hr)}} \times 100$$

COMPARATIVE EXAMPLE 3

The reaction was conducted in the same manner as in Example 1 except that the temperature of the reactor for the later step was changed to 340° C. without changing the temperature of the reactor for the first step. The CLB conversion, the yield of liquefied oil and the yield of naphtha upon expiration of 20 hours from the initiation of the reaction, were 22%, 17% and 1%, respectively. Under these reaction conditions, the yield of liquefied oil and the yield of naphtha were low.

We claim:

1. A process for the hydrogenolysis of a coal liquid bottom containing benzene-insoluble components and having a boiling point of at least 420° C., which comprises:

(a) hydrogenating the coal liquid bottom at a temperature of not higher than 350° C. in the presence of a catalyst comprising an alkali metal, an alkaline earth metal or mixtures thereof and a metal of Group VI A of the Periodic Table to reduce the content of the benzene-insoluble components in the fraction having a boiling point of at least 420° C., to a level of not higher than 10% by weight, and then (b) subjecting the product to hydrogenolysis at a temperature of higher than 350° C. and not higher than 450° C. in the presence of a catalyst comprising a metal of Group VI A of the Periodic Table.

2. The process according to claim 1, wherein each of the reactions of steps (a) and (b) is conducted in a fixedbed system.

3. The process according to claim 1, wherein the catalyst for the reaction in step (a) further includes a metal of Group VIII of the Periodic Table.

4. The process according to claim 1, wherein the catalyst for the reaction of step (b) further includes a metal of Group VIII of the Periodic Table.

5. The process according to claim 1, wherein the coal liquid bottom contains from 10 to 40% by weight of benzene-insoluble components.

6. The process according to claim 1, wherein the coal liquid bottom is obtained by the hydrogenolysis of brown coal, bituminous coal, sub-bituminous coal or lignite.

7. The process according to claim 1, where the coal liquid bottom is obtained by the hydrogenolysis of coal in the presence of a catalyst, followed by deashing of the product.

8. The process according to claim 1, wherein the reaction in step (a) is conducted at a temperature ranging from 250° to 350° C.

9. The process according to claim 8, wherein said reaction temperature ranges from 280° to 340° C.

10. The process according to claim 1, wherein the catalyst of said first stage contains tungsten or molybdenum as the Group VI element.

11. The process according to claim 1, wherein the cayalyst of the first stage contains from 2 to 20% by weight of the Group VI A element and from 0.1 to 10% by weight of the alkali metal, alkaline earth metal or mixture thereof component.

12. The process according to claim 1, wherein said coal liquid bottom feed material is dissolved in a heavy oil solvent.

13. The process according to claim 1, wherein the temperature of said second stage of hydrogenation ranges from 355° to 445° C.

14. The process according to claim 13, wherein said temperature ranges from 370° to 420° C.

* * * * *